US008350698B2

(12) United States Patent
Richman

(10) Patent No.: US 8,350,698 B2
(45) **Date of Patent: *Jan. 8, 2013**

(54) METHOD AND PROTOCOL FOR REAL TIME SECURITY SYSTEM

(75) Inventor: Lawrence Richman, La Mesa, CA (US)

(73) Assignee: Richman Management Corporation, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/174,348

(22) Filed: Jun. 30, 2011

(65) Prior Publication Data

US 2011/0260851 A1 Oct. 27, 2011

Related U.S. Application Data

(63) Continuation of application No. 12/253,826, filed on Oct. 17, 2008, now Pat. No. 7,990,268, which is a continuation of application No. 10/176,565, filed on Jun. 20, 2002, now abandoned, which is a continuation-in-part of application No. 10/139,110, filed on May 4, 2002, now Pat. No. 6,894,617.

(51) Int. Cl.
*G08B 13/00* (2006.01)

(52) U.S. Cl. ..... 340/541

(58) Field of Classification Search ..... 340/541, 340/573.1, 506, 539.1, 539.11, 539.14, 539.17, 340/539.22; 345/7

See application file for complete search history.

(56) References Cited

U.S. PATENT DOCUMENTS 3,736,561 A 5/1973 Rumpel
4,864,494 A 9/1989 Kobus, Jr.
5,132,968 A * 7/1992 Cephus ..... 370/349
5,515,288 A 5/1996 Aberson
5,623,258 A 4/1997 Dorfman
5,699,430 A 12/1997 Krizay et al.
5,745,037 A 4/1998 Guthrie et al.
5,764,146 A 6/1998 Baldwin et al.
5,802,280 A 9/1998 Cotichini et al.
5,861,804 A 1/1999 Fansa et al.
6,034,603 A 3/2000 Steeves
6,204,762 B1 * 3/2001 Dering et al. ..... 340/541
6,271,752 B1 8/2001 Vaios
6,294,953 B1 9/2001 Steeves
6,300,863 B1 10/2001 Cotichini et al.
6,342,915 B1 1/2002 Ozaki et al.
6,384,414 B1 * 5/2002 Fisher et al. ..... 250/339.14
6,400,265 B1 6/2002 Saylor et al.
6,456,261 B1 9/2002 Zhang (Continued)

OTHER PUBLICATIONS

Notice of Allowance for U.S. Appl. No. 12/253,826 (mailed Mar. 25, 2011).

(Continued)

*Primary Examiner* — Phung Nguyen
(74) *Attorney, Agent, or Firm* — Sheppard Mullin Richter & Hampton LLP; Anthony C. Kuhlmann

(57) ABSTRACT

A security system comprises one or more sensor devices configured to detect conditions at one or more sites; one or more checkpoints at each of said one or more sites configured to receive signals from the one or more sensor devices; and a central headquarters processor configured to receive signals indicative of the conditions detected at said one or more sites from the one or more checkpoints. The central headquarters processor is configured to process the signals to determine if an event has occurred.

20 Claims, 8 Drawing Sheets

U.S. PATENT DOCUMENTS

| | | | | |
|---|---|---|---|---|
| 6,505,086 | B1 * | 1/2003 | Dodd, Jr. et al. | 700/65 |
| 6,545,601 | B1 * | 4/2003 | Monroe | 340/521 |
| 6,563,910 | B2 | 5/2003 | Menard et al. | |
| 6,658,348 | B2 | 12/2003 | Rudd et al. | |
| 6,686,838 | B1 | 2/2004 | Rezvani et al. | |
| 6,720,874 | B2 | 4/2004 | Fufido et al. | |
| 6,894,617 | B2 | 5/2005 | Richman | |
| 6,973,478 | B1 | 12/2005 | Ketonen et al. | |
| 7,030,757 | B2 | 4/2006 | Matsuhira et al. | |
| 7,242,295 | B1 * | 7/2007 | Milinusic et al. | 340/541 |
| 2002/0194267 | A1 | 12/2002 | Flesner et al. | |
| 2003/0159070 | A1 | 8/2003 | Mayer et al. | |
| 2003/0206100 | A1 | 11/2003 | Richman et al. | |

OTHER PUBLICATIONS

Non-final office action for U.S. Appl. No. 12/253,826 (mailed Nov. 12, 2010).
Communication for U.S. Appl. No. 10/176,565 (mailed Dec. 1, 2008).
Non-final office action for U.S. Appl. No. 10/176,565 (mailed Apr. 15, 2008).
Final office action for U.S. Appl. No. 10/176,565 (mailed Apr. 30, 2007).
Non-final office action for U.S. Appl. No. 10/176,565 (mailed Jul. 19, 2007).
Non-final office action for U.S. Appl. No. 10/176,565 (mailed Sep. 7, 2006).
Notice of Allowance for U.S. Appl. No. 10/139,110 (mailed Nov. 17, 2004).
Non-final office action for U.S. Appl. No. 10/139,110 (mailed Apr. 19, 2004).
Final office action for U.S. Appl. No. 12/067,271 (mailed Aug. 11, 2011).
Non-Final office action for U.S. Appl. No. 12/067,271 (mailed Dec. 10, 2010).
International Search Report for PCT Patent Application No. PCT/US2005/009408.
Notice of References Cited, PTO-892, Part of Paper No. 20101105, for U.S. Appl. No. 12/253,826.
Notice of References Cited, PTO-892, Part of Paper No. 20080206, for U.S. Appl. No. 10/176,565.
Notice of References Cited, PTO-892, Part of Paper No. 20070706, for U.S. Appl. No. 10/176,565.
Notice of References Cited, PTO-892, Part of Paper No. 20070212, for U.S. Appl. No. 10/176,565.
Notice of References Cited, PTO-892, Part of Paper No. 20020620, for U.S. Appl. No. 10/176,565.
Notice of References Cited, PTO-892, Part of Paper No. 2, for U.S. Appl. No. 10/139,110.
Notice of References Cited, PTO-892, Part of Paper No. 20101130, for U.S. Appl. No. 12/067,271.

* cited by examiner

METHOD AND PROTOCOL FOR REAL TIME SECURITY SYSTEM

This application is a Continuation of U.S. patent application Ser. No. 12/253,826, filed Oct. 17, 2008, which is a Continuation of U.S. patent application Ser. No. 10/176,565, filed Jun. 20, 2002, now abandoned, which is a Continuation-in-part of U.S. patent application Ser. No. 10/139,110, filed May 4, 2002, now U.S. Pat. No. 6,894,617, issued May 17, 2005, each of which are incorporated herein by reference in their entirety for all purposes.

BACKGROUND OF THE INVENTION

1. Field of the Invention

The present invention relates to a multiple site integrated security system method and communications protocol. More particularly, the present invention relates to a human oriented system of security service and a computer implemented universal communications protocol which facilitates communications between real time security hardware and a real time security monitoring software system.

2. Description of the Related Art

In addition to traditional threats to security such as burglary, vandalism and arson, today's complex national and international political conflicts are putting increased pressure on facilities and organizations of all kinds to provide effective security systems for the safety and protection of personnel, property and surroundings.

Devices and systems for the provision of safety and security of persons and property are well known. Examples of different types and kinds of security systems for protection and surveillance methods of building structures and surrounding areas are disclosed in U.S. Pat. Nos. 6,204,762 B1, 6,154,133, 6,097,429, and 5,825,283.

In general, the structure and function of most security systems involves electronic surveillance equipment monitored at a centralized location. Current development of security systems attempts to do away with human-oriented services and replace the human security guard with high technology solutions to security problems. Only a limited number of currently developed security systems utilize a combination of guards in close conjunction with the electronic equipment. Most of the time, these systems involve one guard who monitors a video feed or alarm panel for intrusion or other related alerts. These security systems are commonly built, installed and implemented without any regard for the particular facilities of other systems, for example, the facilities of built-in environmental and climate control, the tracking of people and assets within the building or complex, and fire/smoke detection as well as transport systems such as elevators, etc.

Therefore, it would be highly desirable to have a new and improved security system which not only enhances the human security guard services, but also integrates facilities management, and allows for identification and global positioning satellite (GPS) tracking of people as well as assets such as computers, and other valuable instrumentation, all in a readily scalable configuration utilizing off the shelf electronic security and communications components.

An electronic surveillance system for remote guarding of an area using an operator station including a signal receiver with television display, radiant energy selection control, and energy level controller is known in the prior art. Such a device is described in U.S. Pat. No. 6,204,762 B1. The novel invention remotely controls and directs an apparatus "weapon" for integration with traditionally secured facilities, remote detection devices, closed circuit TV, and a remotely-located, manned control station. While such a computerized system is helpful in detection of unauthorized personnel in a given area and does seek to incorporate pre-existing security devices, there is no provision which would allow for the irreplaceable and highly effective presence of human security guards, guards that are further enhanced by electronic wireless communications and monitoring.

Additionally, the entire system depends upon the installation and presence of numerous hard wired security devices in a given area and is not readily scalable to incorporate larger areas in the surveillance area in a short period of time without extensive outlay of effort and installation of new equipment. The acoustic energy "weapon" used as a deterrent to intruders is not confined to any given space and might pose a threat to anyone, including authorized individuals, within hearing distance.

Therefore, it would be highly desirable to have a new and improved enhanced security guard system which would allow for computerized and wireless communications and monitoring of human security guards and their activities with a centralized location, in addition to conventional security devices and which would be scalable with minimal time and material expenditure, and which would provide for human guards to act as a more rapid and effective deterrent to intruders.

The exit guard system described in U.S. Pat. No. 6,154,133 addresses the requirements of providing areas with detection of movement of a subject along an exit path in an unauthorized direction. This system further provides for a human monitor at a centralized location with added supervision of the deactivation of the security alarm system only by authorized personnel.

However, within this system there is no human security guard on site actively patrolling the area. This electronically augmented human presence is irreplaceable as a deterrent to potential intruders as well as providing for flexibility in terms of monitoring and responding to a variety of situations that might arise.

Therefore, it would be highly desirable to have a new and improved, technologically augmented human presence automatically reporting to a centralized location, or a remote monitoring station through communications over a global computer network or via satellite link, which could then monitor and record guard activities as well as utilize pre-existing event detection technology, such as motion, video and perimeter control devices to alert those guards of real time events taking place on their shift.

U.S. Pat. No. 6,097,429 describes a relatively sophisticated security system utilizing video images obtained from a plurality of cameras relayed to a site control unit equipped with an automated image processor. The images are then relayed to a security system operator who then analyzes the images and informs authorities of an intrusion.

While this system utilizes advanced technological features to distinguish between actual intrusions and false alarms (friend or foe), the absence of a human guard which would serve to discourage intrusions is notably absent. Moreover, the presence of human guards makes those that are present within the facility feel protected and well taken care of, and these individuals will often speak to the security guards or become familiar with them to avoid any misunderstanding as to their access authorization or the like.

Additionally, the highly automated image processor and related complex software used to differentiate between actual foe intrusions and friendly false alarms is inherently limited in its capability to observe, compare and react to the myriad of potential one time or entirely novel situations which might occur. This type of security monitoring can only be accomplished with highly trained, well equipped, and competently supervised human security guards on duty in numbers corresponding to the amount of space or activity required to be secure from outside threats.

Therefore, it would be highly desirable to have a new and improved system for technological augmentation of human guards who are irreplaceable in terms of providing a deterrent to intrusion and who are capable of observing, assessing and responding to novel and unusual situations and whose actions would automatically be reported to a centralized headquarters with integrated automated daily events and incident real time reporting.

Finally, U.S. Pat. No. 5,825,283 provides for an apparatus for monitoring subjects having a location determining device which provides the location of the subject to a processor. The processor then stores and retrieves data generated of received by the processor. The primary means by which the subject is tracked is by usage of a GPS. Comparison of the parameters of given geographical boundaries to the data from the location determining device may determine if the subject has deviated from those parameters. The claimed invention mandates detection of at least one physiological parameter of the subject in order to compare existing subject data previously stored.

This imaginative invention does provide for tracking and determination of the general area in which a subject is to be found and a means by which to compare the location with a pre-determined geographic location. Unfortunately, while the location and tracking device may show a general area in which the subject is located, there is no way of determining the exact location of the subject at any given point in time.

In addition, this system again depends upon a complex processor which must be programmed with any number of parameters. The system may fail to operate properly or may not operate at all if incorporated into a pre-existing security system, especially one having less complex processors available on site.

Therefore, it would be highly desirable to have a new and improved system for technological augmentation of human guards automatically reporting exact location and time to a centralized headquarters with daily events and incident reporting automation which could give exact locations and time records of movement of the guards which would readily incorporate pre-existing hardware and software. Moreover, it would be highly desirable to enable said guards to wear a garment which would incorporate a wireless communications apparatus, or have said guards carry hand-held computers for this purpose.

With respect to security system and environmental system monitoring there have been no significant advances recently, especially in the area of software development that can be used to integrate far flung and varying system hardware configurations. However, the development of global computer networks such as the Internet have sparked new languages capable of being effectively used in numerous alternative applications. One such language is Hypertext Markup Language or HTML and another such language is Extensible Markup Language or XML.

Most documents on the Web are stored and transmitted in HTML. HTML is a simple language well suited for hypertext, multimedia, and the display of small and reasonably simple documents. HTML is based on SGML (Standard Generalized Markup Language, ISO 8879), a standard system for defining and using document formats.

SGML allows documents to describe their own grammar—that is, to specify the tag set used in the document and the structural relationships that those tags represent. HTML applications are applications that hard-wire a small set of tags in conformance with a single SGML specification. Freezing a small set of tags allows users to leave the language specification out of the document and makes it much easier to build applications, but this ease comes at the cost of severely limiting HTML in several important respects, chief among which are extensibility, structure, and validation.

Extensibility. HTML does not allow users to specify their own tags or attributes in order to parameterize or otherwise semantically qualify their data.

Structure. HTML does not support the specification of deep structures needed to represent database schemas or object-oriented hierarchies.

Validation. HTML does not support the kind of language specification that allows consuming applications to check data for structural validity on importation.

In contrast to HTML stands generic SGML. A generic SGML application is one that supports SGML language specifications of random complexity and makes possible the qualities of extensibility, structure, and validation missing from HTML. SGML makes it possible to define your own formats for your own documents, to handle large and complex documents, and to manage large information repositories. However, full SGML contains many optional features that are not needed for Web applications and has proven to have a cost/benefit ratio unattractive to current vendors of Web browsers.

The World Wide Web Consortium (W3C) has created an SGML Working Group to build a set of specifications to make it easy and straightforward to use the beneficial features of SGML on the Web. Extensible Markup Language (XML) is a simple, very flexible text format derived from SGML (ISO 8879). Originally designed to meet the challenges of large-scale electronic publishing, XML is also playing an increasingly important role in the exchange of a wide variety of data on the Web.

XML advantages:

Enables internationalized media-independent electronic publishing

Allows industries to define platform-independent protocols for the exchange of data, especially the data of electronic commerce Delivers information to client users in a form that allows automatic processing after receipt.

Makes it easier to develop software to handle specialized information distributed over the Web Makes it easy for people to process data using inexpensive software Allows people to display information the way they want it, under style sheet control Provides a standard packaging/transport mechanism for any type of information XML Syntax The best way to appreciate what XML documents look like is with a simple example. Imagine a company that sells products on-line. Marketing descriptions of the products are written in HTML, but names and addresses of customers, and also prices and discounts are formatted with XML. Here is the information describing a customer:

```
<customer-details id+ "AcPharm39156">
 <name>Acme Pharmaceuticals Co.</name>
 <address country+ "US">
  <street>7301 Smokey Boulevard</street>
```

-continued

```
<city>Smallville</city>
  <state>Indiana</state>
  <postal>94571</postal>
</address>
</customer-details>
```

The XML syntax uses matching start and end tags, such as <name> and </name>, to mark up information. A piece of information marked by the presence of tags is called an element: elements may be further enriched by attaching name-value pairs (for example, country+"US" in the example above) called attributes. Its simple syntax is easy to process by machine, and has the attraction of remaining understandable to humans. XML is based on SGML, and is familiar in look and feel to those accustomed to HTML.

Building Applications with XML

XML is a low-level syntax for representing structured data. You can use this simple syntax to support a wide variety of applications. For this reason, XML now underpins a number of Web markup languages and applications.

Outside and inside W3C, many groups are already defining new formats for information interchange. The number of XML applications is growing rapidly, and the growth appears likely to continue. There are many areas, for example, the health-care industry, the on-line revenue generation, database analysis and government and finance, where XML applications are used to store and process data. XML as a simple method for data representation and organization will mean that problems of data incompatibility and tedious manual re-keying will become more manageable.

Therefore, it would be highly desirable to have an XML based communications method and protocol capable of enabling the integration of varying security and environmental hardware monitoring devices, and allowing communication between said devices and a core system application for the purpose of monitoring security systems and/or environmental systems within one or more subject sites, both on site and remotely using direct and indirect means.

SUMMARY OF THE INVENTION

It is therefore a principal object of the instant invention to provide a multiple site, integrated security system which incorporates and enhances the performance of human guards within said security system and a method and protocol for communications between real time hardware and a real time security monitoring software system.

It is another object of the instant invention to provide the human guards with the latest technology, in the form of wearable and hand held computers or other data processors capable of wireless communications, in order to make the guards more knowledgeable and responsible to the guarded facilities complex interactive environment.

Another object of the instant invention is to provide a method and communications protocol which would be flexible in incorporating new technology and pre-existing hardware equipment thus providing a high level of integration with off the shelf security devices now existing or not yet conceived.

It is a further object of the instant invention to provide a system of security which is able to be custom configured and scaled up or down, by being individually tailored to site conditions such as site component configurations, checkpoint locations, building type material, building transportation systems, facilities environmental control systems, such as climate control, fire and smoke detection, and other varied parameters.

Yet another object of the present invention is to provide a system which would automatically monitor and control certain movable and fixed site conditions such as people and vehicles at checkpoints, safety systems, access control systems, position sensors, transportation control systems, power supply systems, water and hydraulic control systems, warning systems, lighting systems, communications systems and miscellaneous site-specific systems such as greenhouse temperature controls.

Still another object of the instant invention is to provide a system for security which monitors the identification and authorization of personnel inside secured areas through use of a two points access subsystem composed of a fixed device installed at a checkpoint and a mobile device (wearable or hand held) carried by authorized personnel which could be configured to integrate pre-existing security systems without modification of the core program.

Another object of the instant invention is to provide a guard activity and real time reporting support system which includes a scheduled building and real time guard tour tracking system.

Yet another object of the instant invention is to provide a computer implemented communications protocol whereby bi-directional data and command transmissions may occur between a base station and any designated personal identification devices, which enables assistance deployment and transmits the location of the person, group of persons, security guards and/or guard vehicles.

A further object of the instant invention is to provide a computer implemented communications protocol which records real-time object identification data and tracking subsystems data for indoor and outdoor areas.

Another object of the present invention is to provide a site video monitoring system that generates data which will be recorded, transmitted and displayed at a base station (computer or server configuration) with the option of video data processing, to recognize and alert of certain predetermined events, such as access verification, etc.

Still another object of the invention is to provide a computer implemented communications protocol which will allow integration of hardware already existing at the site into the system without requiring purchase of redundant hardware.

Yet another object of the invention is to provide a computer implemented communications protocol and system that allows for data exchange between base station and headquarters and between base station and any other specified hardware system and any other off-site computers (such as remote workstations).

It is also another object of the present invention to provide a computer implemented communications protocol and system which would automate time sheets, payroll recap and other accounting operations.

It is another object of the present invention to provide a computer implemented communications protocol and system which provides complete availability of site level information from a centralized headquarters, or remotely away from a centralized headquarters.

Still another object of the present invention is to provide a computer implemented communications protocol and system which would provide access to historical information such as time sheets, event logs, and alert logs to designated personnel.

Yet another object of the present invention is to provide a means of communication via the Internet with a central console monitoring application.

Still another object of the present invention is to provide a system with failure-resistance and robustness against hardware denials and intentional attacks by providing data backup on both facilities site and a security headquarter levels.

It is yet another object of the present invention to provide a computer implemented communications protocol capable of communicating with preexisting and/or pre-built system configurations to be installed at specific kinds of sites.

It is another object of the present invention to provide a computer implemented communications protocol which would support several levels of software security, users, data, application and communication, and whereby security tasks are performed and verified by the guard during the guard tour and that information is recorded by the guard in a checkpoint data processing application, then a base station processing application. The ability to provide central monitoring of guard tours is dependent upon novel wearable and hand held devices which are capable of wireless communications with the data processing checkpoint stations.

Briefly, the objects and advantages of the present invention are realized by providing a computer implemented process for real time communications between security hardware devices and a security system core application (SCA). The security devices transmit data in varying device language. A security site checkpoint computer collects data messages from these security devices and translates the device language into standardized converted messages before input into and use by the SCA. The SCA then generates a message and transmits converted messages via various direct and indirect means to other computers running the security SCA, Base station computers then receive said messages and analyzes, reports and logs the transmitted messages for the purpose of monitoring environmental and security conditions within a subject site.

Therefore, a new and improved computer implemented communications protocol is provided, which is an XML based communications protocol for security monitoring purposes. This unique XML based communications protocol is implemented through numerous modules which receive and convert data messages from diverse security devices and sensors, standardize and send converted messages, and encrypt and decrypt said data messages as necessary. With the set modules, the data messages are filtered and transmitted from checkpoint computers to base station computers, which analyzes, reports and logs environmental as well as security events within a subject site. The resulting integrated security system provides better trained security guards, who are more alert and responsive, and more closely supervised and easily scheduled, enhanced financial monitoring, more accurately paid and costed security services, better archived and reported security related events, as well as being better coordinated with public agencies, enhanced safety, and readily upgraded and integrated with existing and future technologies.

Other objects and advantages of the present invention will become apparent to those of skill in the art upon contemplation of the disclosure herein in conjunction with the drawings as described below.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein.

DESCRIPTION OF THE PREFERRED EMBODIMENTS

Figure 1:
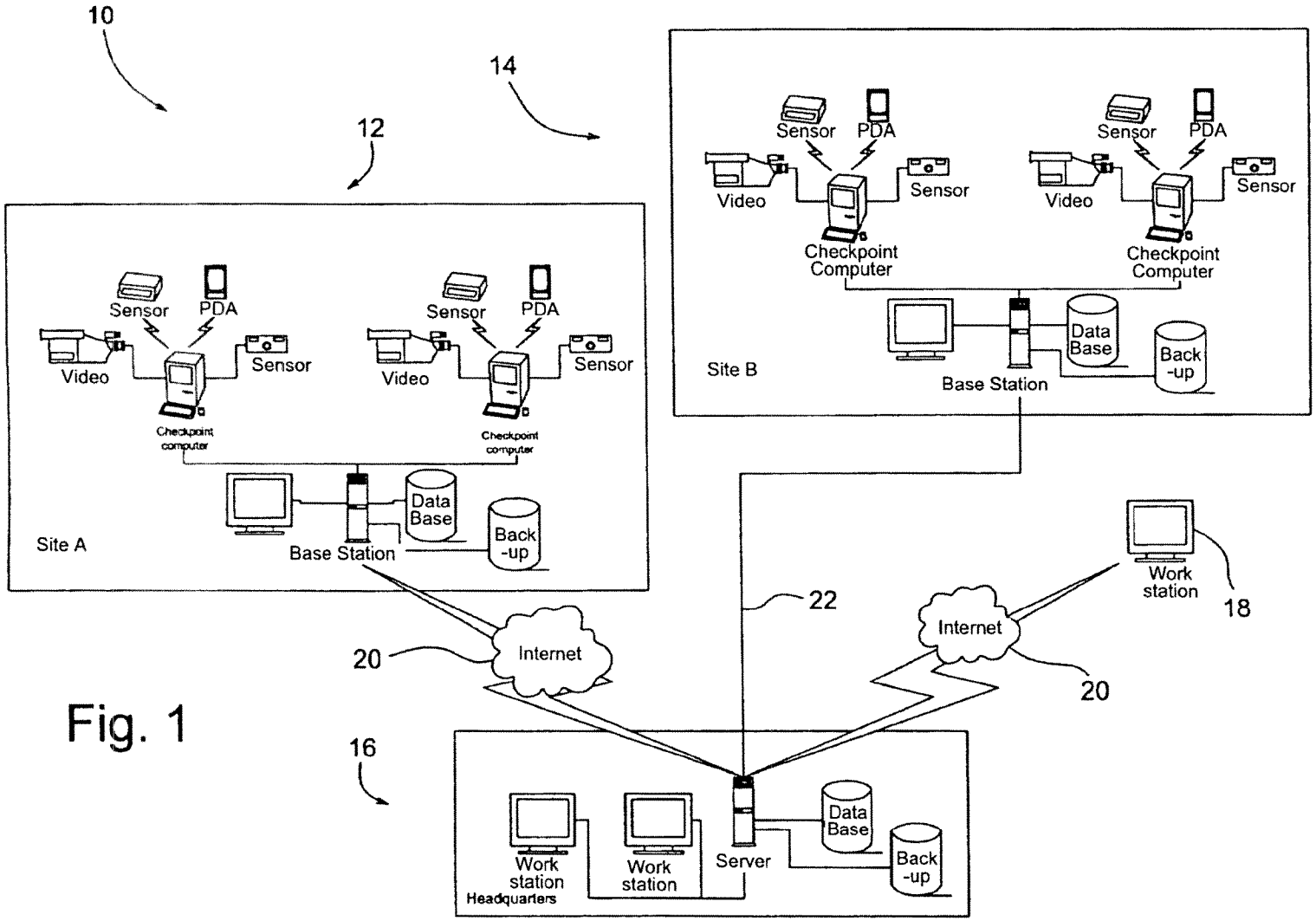
FIG. 1 is a representational diagram of a multiple site integrated security system constructed in accordance with the present invention.

Referring now to the drawings, and more particularly to FIG. 1 thereof, there is shown a new and improved multiple site integrated enhanced human oriented security system 10. Specifically, the multiple site integrated security system 10 as represented by FIG. 1 and constructed in accordance with the present invention, uses direct communication 22 and indirect communication (for example use of a global computer network like the Internet 20) methods of communication between a central headquarters 16 and one or more facilities sites 12 and 14. Direct communication is defined as a point-to-point connection containing a hard wired and/or wireless components in which the sender and receiver are not separated by switching nodes. One example of this is the communication between a wireless transmitter and a wireless receiver. On the other hand, indirect communication can be defined herein as a connection containing hard wired and/or wireless components in which the sender and receiver are separated by switching nodes. This is best exemplified by a local area network (or LAN) and a global computer network like the Internet.

The new multiple site integrated security system 10 may be tailored to site specific needs or pre-existing hardware and equipment as represented by a Site A security subsystem 12 and a Site B security subsystem 14. The sites may be in communication with the integrated headquarters server subsystem 16 by means of direct communication 22 as exemplified by communication with the Site B security subsystem 14. This direct communication 22 between the sensors and the checkpoint data processing subsystems, and between the checkpoint data processing subsystems and the base station CPUs may also be accomplished through the use of existing electrical power lines located at the guarded facility or site.

In the alternative, communication with the integrated headquarters server subsystem 16 may be accomplished via a global computer network, such as the Internet, as exemplified by communication between the integrated headquarters server subsystem 16 and the Site A security subsystem 12. Furthermore, it is contemplated that said communications made be via a global orbiting satellite system (such as the existing global positioning satellite or GPS system) or a similar high altitude or outer space vehicle sensing the data transmissions. Moreover, any energy transmission may be used by the security system, for example, including but not limited to shortwave, long wave, microwave, X-ray, gamma ray, radio frequencies, and cellular telephone frequencies.

Figure 2:
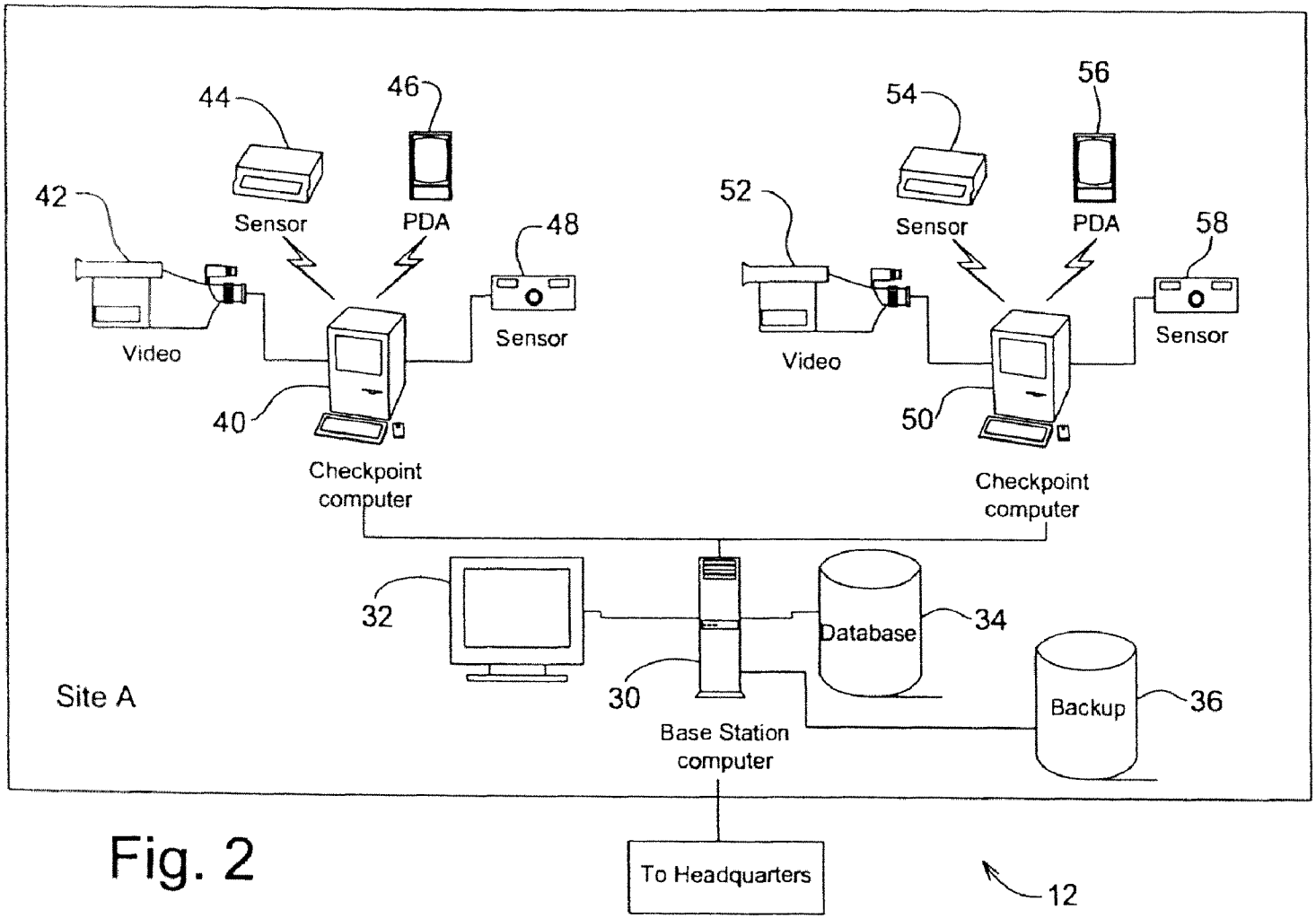
FIG. 2 is an enlarged detailed diagram of a communications scheme between multiple checkpoint data processors and a central base station computer, constructed in accordance with the present invention.

Turning now to FIG. 2, there is shown a more detailed view of the Site A security subsystem 12. The base station central processing unit (or CPU) 30 is in communication with checkpoint data processors or computers as exemplified by checkpoint computer 40 and checkpoint computer 50. The checkpoint data processing subsystems 40 and 50 are installed in a local area and connected to all hardware devices providing security in this area. The checkpoint data processing subsystems 40 and 50 collect information from wireless sensors 44 and 54, and other peripheral equipment such as wireless personal digital assistant (or PDA) 46 and 56, hard wired sensors 48 and 58 and hard wired video cameras 42 and 52. Hard wired sensors 48 and 58 may be pre-existing units, or in the alternative, may be off the shelf security equipment designed to be installed and operated as motion sensors, heat sensors, etc. Moreover, it is contemplated that the video transmission feeds may come from both hard wired video cameras such as 42 and 52 as shown, or from wireless video feeds (not shown). In some instances, automated video monitoring may be employed at the checkpoint level, or in the alternative, at the base station level of architecture.

The checkpoint data processing subsystems 40 and 50 then process all of the information gathered from any peripheral equipment as exemplified by 42, 44, 46, 48, 52, 54, 56, and 58, and transmits the event sensor information to the base station computer or CPU 30. The base station computer or CPU 30 accepts information from all checkpoint data processing subsystems 40 and 50, and any others in communications therein, stores the information in a database 34, provides access to this information to personnel in real-time mode and generates alerts if indicated by alert logic. Activity on the base station may be monitored in real time via a workstation monitor 32 or remotely (see FIG. 3 below). Furthermore, it is contemplated that checkpoint data processing subsystems 40 and 50 may not be computers in the literal sense, but may be replaced in certain situations with data processing units of varying sizes, complexities and configurations.

Figure 3:
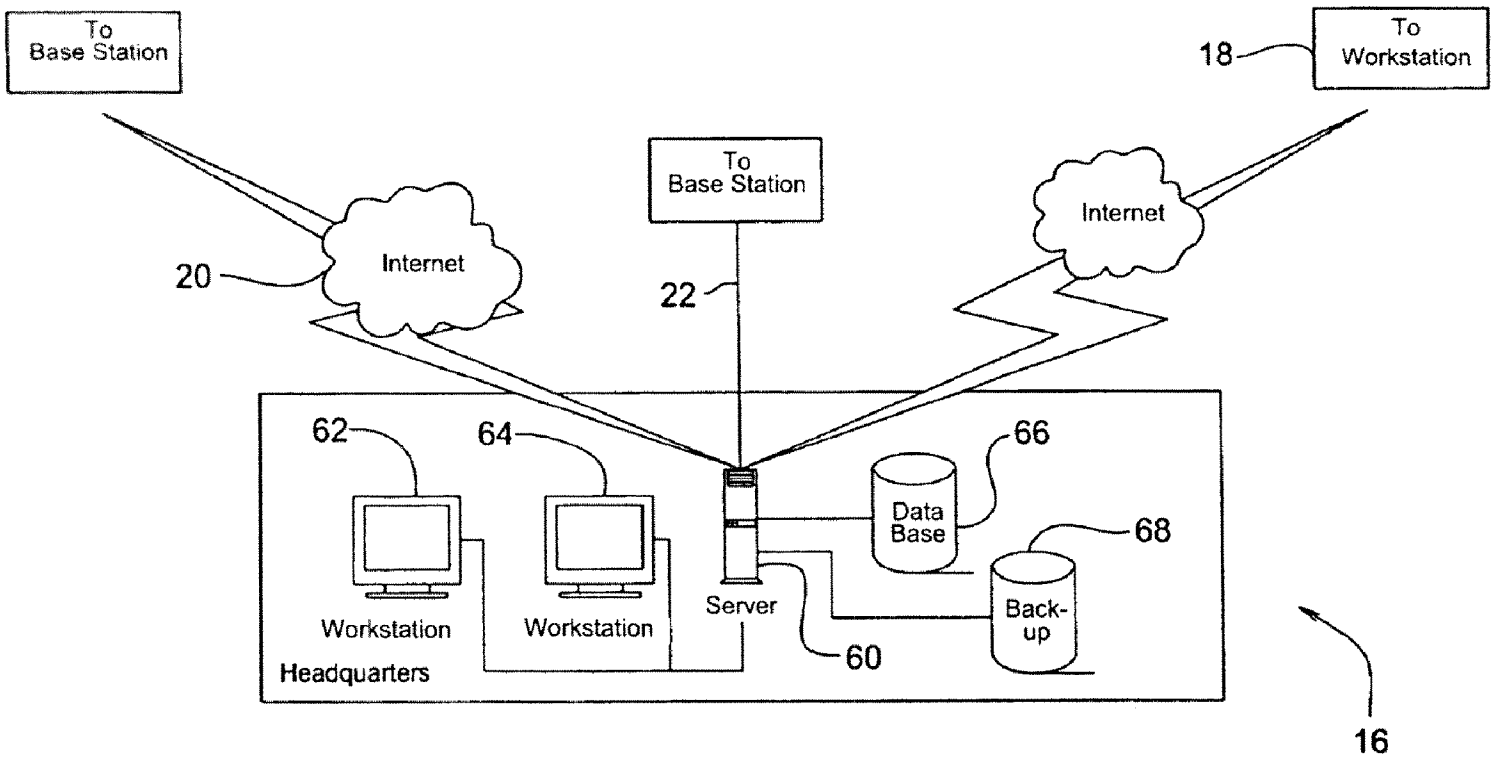
FIG. 3 is an enlarged detailed diagram of a headquarters server with multiple workstations and hard wired as well as global computer network communications capabilities, constructed in accordance with the present invention.

FIG. 3 illustrates a representational diagram of the integrated headquarters server subsystem 16. The headquarters server 60 is in communication with one or more of the base stations by means of a global computer network such as the Internet 20 or via a hard wired connection 22. The information from the headquarters server 60 may be viewed at headquarter workstations 62 and 64 or at widely remote workstations 18 by means of a global computer network (such as the Internet, satellite feeds) or by any other hard wired and/or wireless means.

The server subsystem 16 comprises a database memory unit 66 and a back-up database memory unit 68. All of the information generated by all other components of the security system 10 are stored within the database memory unit 66 and further backed up within database memory unit 68. This enables generation of reports aimed at the scheduling, planning, monitoring, controlling, tour event recording, sensed event recording and paying of human security guards on duty at all of the guarded facilities (Site A, Site B, etc.) and other monitored sites. Furthermore, real time monitoring of events within secure facilities is recorded to enable faster, more effective use of guard supervision, decision making, intrusion intervention and deployment, among many other contemplated guard tasks.

Figure 4:
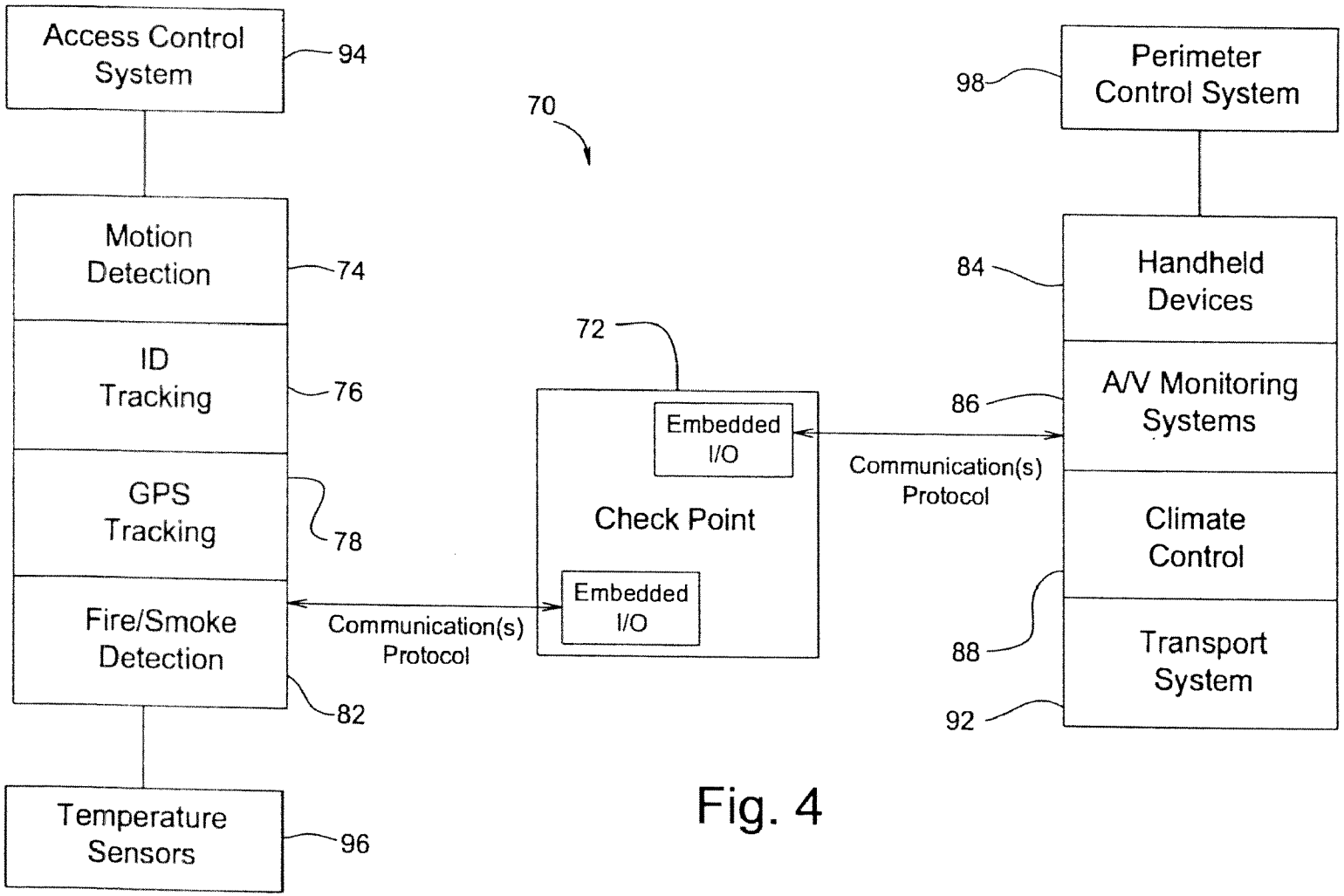
FIG. 4 is a block diagram of the checkpoint data processing architecture and communications system between the security system event sensors and said checkpoint data processor, in greater detail, constructed in accordance with the present invention.

A schematic diagram of checkpoint computer communications options 70 is illustrated in FIG. 4. Another embodiment of a checkpoint computer 72 receives and records information from peripheral event sensor equipment. Most of these devices, such as an access control system 94 coupled with a motion detection device 74, an identification or ID tracking device 76, an UPS tracking system or tracking device 78, a temperature sensor 96 coupled with a fire and smoke detection device 82, perimeter control systems 98, a hand held device 84 such as various security guard communications equipment or a PDA-type device, video camera subsystems 86, climate control subsystems 88 such as heating ventilating and air conditioning (HVAC) subsystems, and transport subsystems 92 such as elevator control device, will all send information instantly and simultaneously to the checkpoint computer 72 by means of a security system communications protocol through an embedded Input/Output (I/O) microprocessor, as shown within the checkpoint computer 72.

Site specific communication protocols, to collect data from sensors, will be developed and deployed for each project. The universal communications protocol, comprised of an encrypted XML-enabled proprietary software program, will direct communications between the checkpoint data processing subsystems or checkpoint computers and the base stations as well as any headquarters servers deployed within the system (see FIG. 5 and FIG. 6 below).

Figure 5:
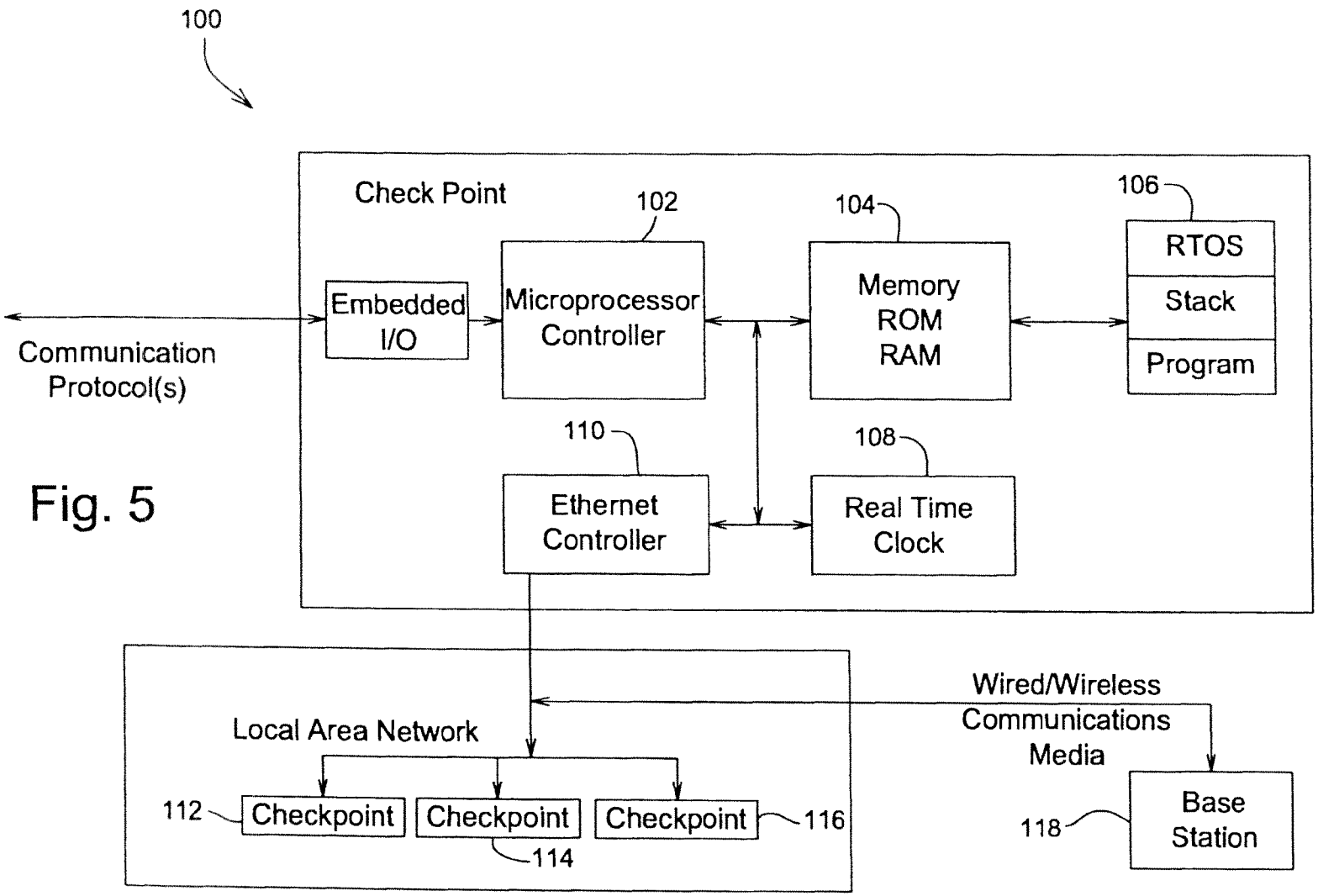
FIG. 5 is a block diagram showing the checkpoint hardware architecture in greater detail, including communications routes between numerous checkpoint data processing units and a base station, constructed in accordance with the present invention.

FIG. 5 is a block diagram of a checkpoint computer hardware architecture in greater detail 100. The CPU microprocessor controller 102 converts the incoming and outgoing signals by means of application software which is stored in the memory (ROM and RAM) 104 of the checkpoint. The real time operating system RTOS/Stack/Program module 106 and the real time clock 108 will run the software independently. Each checkpoint 100 will be equipped with an Ethernet controller 110 on site to interface with other PC systems 112, 114, and 116 such as sensors, controllers and other devices.

Communications within the local area network (LAN) linking the checkpoint data processing subsystems together, and the base station CPU 118 is accomplished either by means of hard wired or wireless communications media. It is also contemplated that these communications may be directed over existing power lines in and around the guarded facilities. By using the existing power supply and routing lines, the security system can be readily integrated into almost any environment, facility or site which includes any existing power supply lines into or out of the building, campus or complex.

Figure 6:
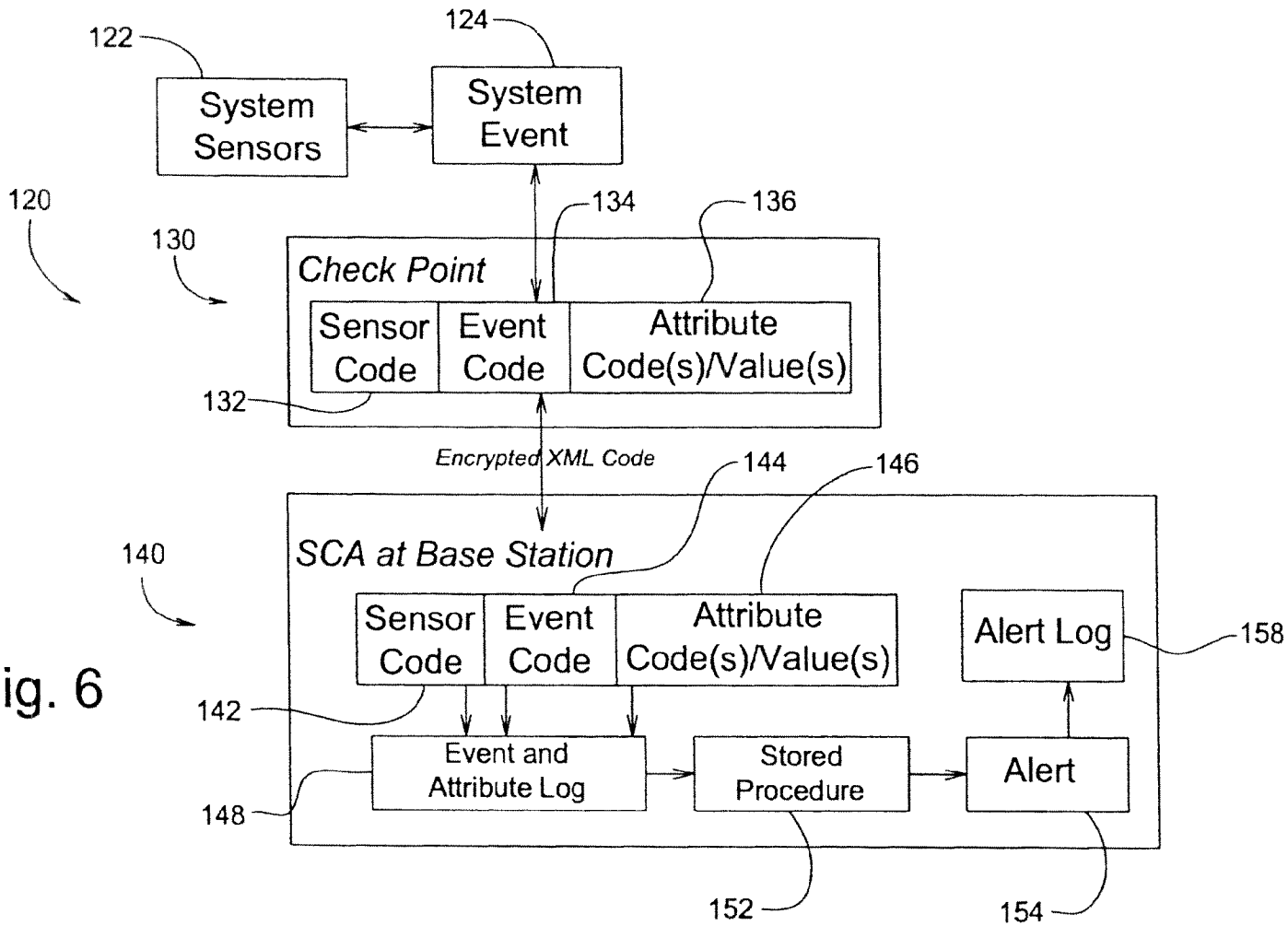
FIG. 6 is a block diagram of an integrated security system encrypted XML communications protocol illustrating communications between system sensors, checkpoint data processing units and the system core application at a base station, constructed in accordance with the present invention.

Turning now to FIG. 6, there is illustrated a block diagram of an integrated security system encrypted XML communications protocol 120 exemplifying communications between checkpoints and the system core application at a base station, as constructed in accordance with the present invention. The system sensors 122 communicate any (and all) system event 124 to a checkpoint 130 via a custom protocol. A sensor code 132 identifies the sensor device that transmitted the system event 124. An event code 134 identifies the actual event and attribute code(s) and value(s) 136 together describe software values for the system event 124 and each individual system event as reported. Each system event 124 can have several attributes. The value of an attribute could be anything from an integer, a string, an image or other data file.

The attribute code(s) and value(s) 136, together with associated sensor code 132 and event code 134 for a given system event 124, are detected and processed by the checkpoint encrypted XML communications protocol software which generates the encrypted XML message which can then be transferred over the network, LAN or a global computer network such as the Internet. After the encrypted attribute code(s) and value(s) 146, sensor code 142 and event code 144 have been received by the security system core application (shown as SCA in FIG. 6) at the base station (shown as Base Station in FIG. 6) 140, the SCA at Base Station will process and decrypt the incoming XML message. The event code 144 and the sensor code 142 will generate an event in the event log and attribute log 148.

Meanwhile, a stored procedure 152 will process the new record in the event log and attribute log 148. For example, the stored procedure 152 will compare the attribute code values to those of the alert values stored in the database and generate an alert 154 accordingly. The alert 154 is then stored in the alert log 158. With the three basic elements, sensor code 132, event code 134 and attribute codes 136, it is possible to describe the communication between the base station CPU 30 and the checkpoint computer 40 for any type of device. Therefore, once programmed, using the encrypted XML protocol 120, the integrated security system can communicate with any off the shelf security device, such as motion sensors, etc., as well as with any facilities subsystem monitoring devices, such as climate control or fire and smoke detection devices.

Figure 7:
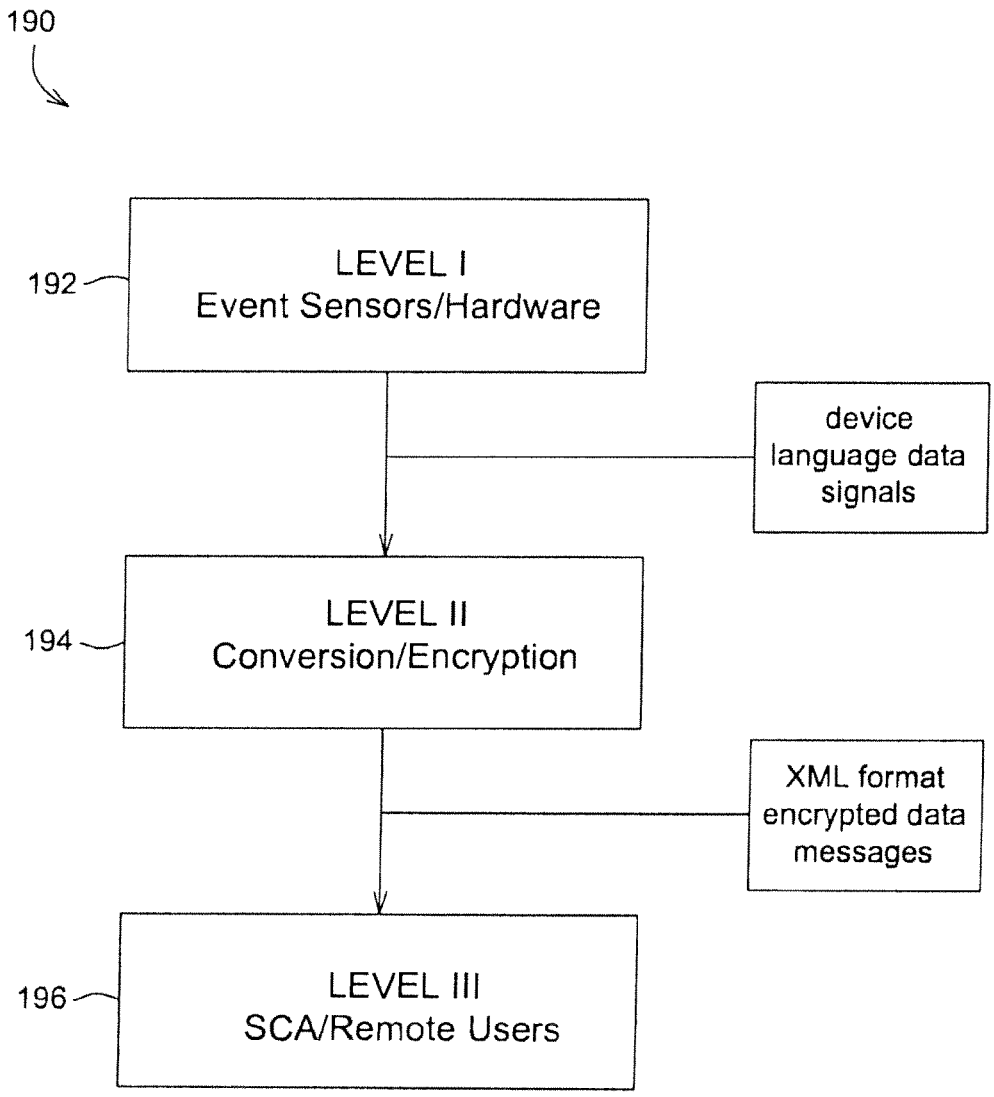
FIG. 7 is a block diagram illustrating the three basic levels of architecture in the strategy and functioning of the overall method and protocol for real time security system communications.

FIG. 7 is a block diagram illustrating the three levels of architecture of the strategy and functioning of the overall method and protocol 190 for real time security system communication. There are three levels of organization within the protocol. Level I 192 includes the security site sensors, other installed security and environmental monitoring hardware devices and any embedded computer systems. Level II 194 includes the security site checkpoint computers. Level III 196 includes the site base station computers and any off-site headquarters computers, and any other off site computers.

Referring now to FIG. 7, in operation, under Level 1190, security devices and sensors transmit data in device language specific for that device or sensor. Under Level II 192 a checkpoint data processing unit collects data messages from various site security devices and sensors in unique device language and translates these messages into standardized messages to be passed on to the SCA. This is accomplished by generating a message based upon converted coded data messages and transmitting the converted messages to computers containing the SCA.

Under Level III 196, base station computers and/or off site headquarters computers, or any other off site computers (such as remote workstations), analyze the coded transmitted messages whereby such analysis is used to generate reports and logs for the purpose of effectively monitoring the environmental and security conditions within a subject site.

Therefore, Level I 190 operations include data transmission from any number of existing, or yet to be created, security devices and event sensors, either off the shelf units and/or customized combinations, all having their own specialized and unique device language transmitting components and qualities. In this regard, the present invention can be programmed to receive all of the data message formats originating from any and all of these devices, then be integrated into any site for security and/or environmental monitoring in a customized and readily scalable fashion.

Figure 8:
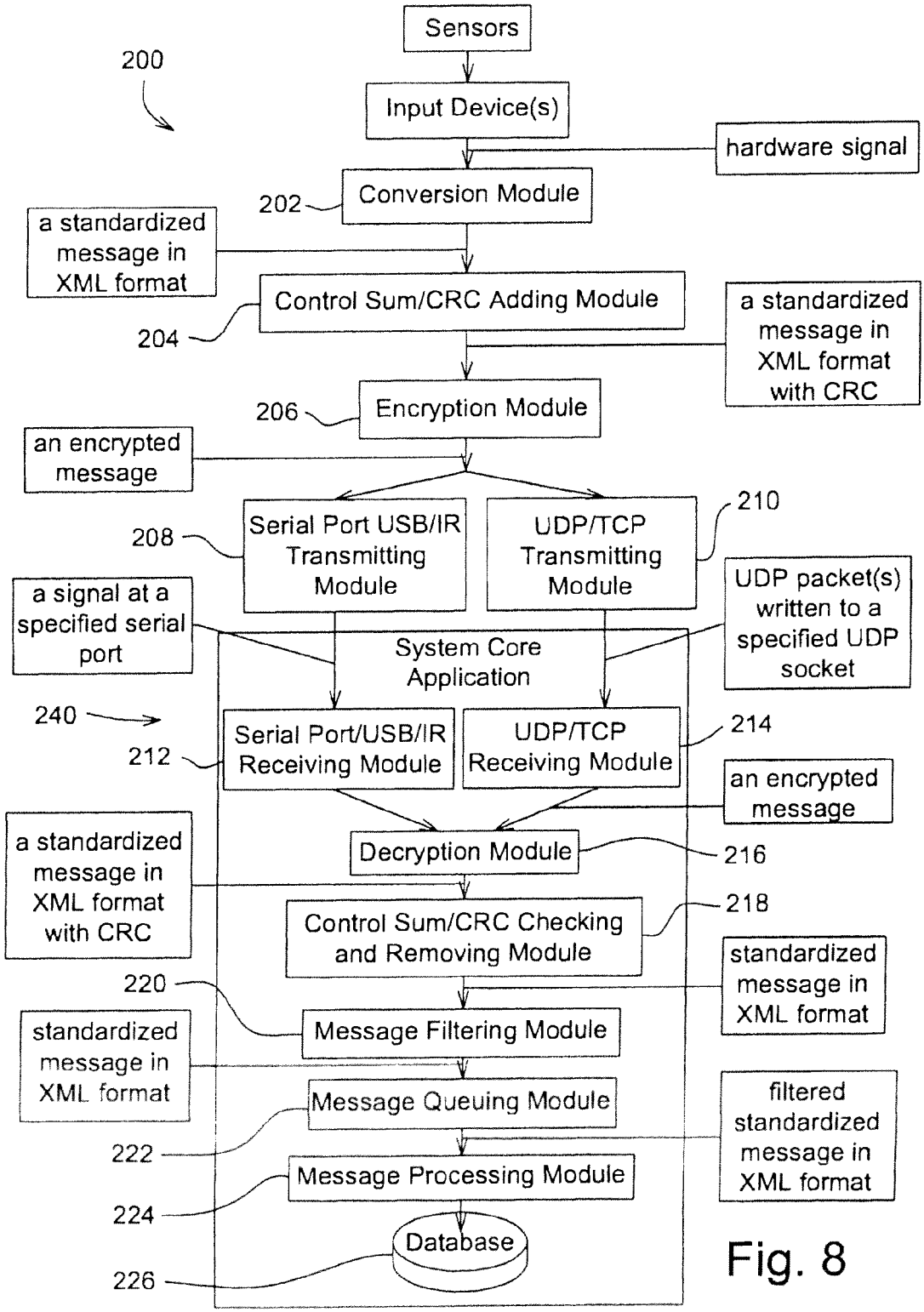
FIG. 8 is a block diagram of the XML based communications protocol illustrating the interaction of input devices, conversion and encryption modules, with the various modules within a system core application, constructed in accordance with the present invention.

FIG. 8 is a block diagram of the XML based communications protocol 200 illustrating in greater detail the interaction of input devices, conversion and encryption modules, with the various modules within a system core application, constructed in accordance with the present invention.

Referring now to FIG. 8, a breakdown of the core system Level II and Level III component modules that comprise the XML based communications protocol is as follows:

Level II SCA Communications Protocol Modules

1. Conversion Module 202. This module receives data from security hardware devices of varying types in their own specialized unique data format and converts this data into a standardized XML formatted message. Each unique hardware device requires a separate customized conversion module to translate its data into the coded SCA XML format for the purpose of further analysis. Thus, for this module, the input is a varying hardware signal, and the output is a standardized message in XML format.

2. Control Sum/CRC Adding Module 204. This module assures data integrity by calculating a checksum, CRC or any other data integrity control element and appending it to each previously generated standardized XML message. This enables the SCA (under Level III) to verify the accuracy of the messages following data encryption, transmission, and decryption. In this way unauthorized, unwanted, deceptive, and/or decoy messages are detected and potential security breaches thwarted, and only verified messages are acted upon. Thus, for this module, the input is a standardized message in XML format, and the output is a standardized message in XML format with an appended checksum, CRC or any other data integrity control element.

3. Encryption Module 206. This module encrypts each XML message for privacy protection during subsequent transmission and data processing procedures. In this way, even messages which are intercepted and collected are not readable by an individual or entity outside the security monitoring system. Thus, for this module, the input is a standardized message in XML format with an appended CRC element, and the output is an encrypted message.

4. Serial Port/USB/IR Module 208. This module writes an encrypted message via a serial port, Universal Serial Bus (USB), Infrared (IR) or any other hardware based upon similar technology. It is used when there is a direct connection between a checkpoint computer running the Conversion Module (as described above) and a computer running the SCA. Thus, for this module, the input is an encrypted message, and the output is an encrypted message sent to a specified serial port, USB, IR or any other hardware based upon similar technology.

5. UDP/TCP Transmitting Module 210. This module sends an encrypted specialized SCA coded message to a User Datagram Protocol (UDP), Transmission Control Protocol (TCP) or any other network communication protocol socket on a computer. It is used when there is a hard-wired or wireless local network connection between a checkpoint computer and a computer running the SCA. Thus, for this module, the input is an encrypted message and the output is an encrypted message sent to a specified socket.

Level III SCA Communications Protocol Modules

6. Serial Port/'USB/IR Receiving Module 212. This module reads an incoming message from a serial port, USB, IR or any other hardware based upon similar technology. It is used when there is a connection between a checkpoint computer and a computer running the SCA. Thus, for this module, the input is an encrypted message at a specified serial port, USB, IR or any other hardware based upon similar technology, and the output is an encrypted message.

7. UDP/TCP Receiving Module 214. This module reads a message from a UDP, TCP or any other hardware based upon similar technology, socket on a computer. It is used when there is a connection between a checkpoint computer and a computer running the SCA. Thus, for this module, the input is an encrypted message read from a specified socket, and the output is an encrypted message.

8. Decryption Module 216. This module decodes an XML based SCA coded message back into standardized XML format. Thus, the input for this module is an encrypted message, and the output is a standardized message in XML format with an appended data integrity control element.

9. Control Sum/CRC Checking and Removing Module 218. This module checks each message's data integrity control element. If correct, it removes the control element from the standardized XML message. If incorrect, it stores the incorrect message and generates an error message. Thus, for this module, the input is a standardized message in XML format with an appended data integrity control element, and the output is a standardized message in XML format, or an error message.

10. Message Filtering Module 220. This module accepts or rejects received XML messages depending upon whether the SCA functioning determines that a duplicate was already processed and recorded. Thus, for this module, the input is a standardized message in XML format, and the output is a standardized message in XML format which gets sent to the message queuing module (namely, the last message in the queue.

11. Message Queuing Module 222. This module queues all standardized XML format messages for processing, analysis, and recording into the database. Thus, for this module, the input is a standardized message in XML format (namely, the first message in the queue), and the output is a standardized message in XML format sent for further processing or idle operation.

12. Message Processing Module 224. This module parses each filtered message, analyzes it according to the SCA program criteria, generates a report or numerous reports, and alerts and record (logs) all activity into the database 226. Thus, the input for this module is a standardized filtered message in XML format, and the output is one or more reports, alerts and database records.

Examples of XML Communication Protocol Operation

The focus of the instant invention is on the communication between the checkpoint computers and the base station (BS). The main concept of the protocol between checkpoints's and BS's is determined by three elements, the sensor code, the event code and the attribute codes:

Sensor code: The sensor code is the identification of the sensor/device that produces a particular event.

Event code: The event code is the identification of the actual event that happened. The event code, together with the sensor code is unique and will be logged in the event log.

Attribute code: The attribute codes are attributes of the event code and describe values for the event. Each event can have several attributes. The value of an attribute could be anything from an integer to a string to an image or other data.

Take a movement sensor for example. At 10:23:15 a guard passes a movement sensor with sensor code "1234." The event code is described as "movement." This particular data is gathered in the checkpoint. The checkpoint software will then generate the XML code, which would look like this:

```
<sensor code = "1234"
    <event code = "movement">
        <Attributes>
        <attribute code="state" value="active"
        <attribute code="time" value="10:23:15 "
        </attributes>
    </events>
</sensor>
```

The generated code by the checkpoint could be encrypted (see security protocol) in order to keep the information undisclosed while it is transferred over the network or internet. After these 3 elements have been received by the BS, the SCA will process and decrypt the incoming XML code. The "event code" and "sensor code" will generate an entry in the event log. An SQL trigger or stored procedure will process the attributes of the event. They will compare the attribute values to the alarm values stored in the database and generate an alarm event accordingly. The alarm event is stored in the alarm log.

EXAMPLES

With the three basic elements, sensor code, event code and attribute codes, it is possible to describe the communication between the BS and the checkpoint computer for any type of device.

Example 1

At 1:00 a window breaks on the $5^{th}$ floor of a building. The detector has code "1111".

```
<sensor code = "1111 "
    <event code = "window broken"
        <attributes>
        <attribute code="state" value="active">
        <attribute code="time" value="1:00 AM">
        <attribute code="floor" value="5 ">
        </attributes>
    </events>
</sensor>
```

The attributes make it possible to send an indefinite number of information about the event that occurred.

Example 2

Suppose a tenant wants to access room 5 of a building. The access to the room is secured with a keypad, which asks for a password and user name. The flow of events will be as follows:

1) Information about entered keypad information is sent to the checkpoint over a field bus. The checkpoint processes the received data and generates the XML code:

```
<sensor code = "Authorization procedure"
    <event code = "login">
        <attributes>
        <attribute code="Username" value="User1 ">
        <attribute code="Password" value="Guest">
        <attribute code="time" value="3:00 PM">
        <attribute code="room" value="5 ">
        </attributes>
    </events>
</sensor>
```

2) The XML code is encrypted by the checkpoint and transferred to the SCA on the BS.
3) The SCA will decrypt the XML code and process the information. The access rights of this particular person will be checked in the database.
4) The SCA produces XML code

```
<sensor code = "Authorization procedure"
    <event code = "login">
        <attributes>
        <attribute code="Validation" value="granted">
        <attribute code="time" value="3:00 PM">
        <attribute code="room" value="5 ">
        </attributes>
    </events>
</sensor>
```

5) The SCA will encrypt this code and send it to the checkpoint.
6) The checkpoint decrypts and processes the received XML code and opens the door.

Example 3

If for example the door access would be secured with fingerprint or eye detection the code would look as follows:

```
<sensor code = "Authorization procedure">
    <event code = "login">
        <attributes>
        <attribute code="Fingerprint Data"
        value=                          "011001010010010 10
                                         10010010010010010
                                         01010010010010010
                                         00101001001001011
                                         10101010101010010
                                         010010000101111 ">
        <attribute code="time"
        value="3:00 PM">
        <attribute code="room" value="5 ">
        </attributes>
    </events>
</sensor>
```

Security Protocol

There are several possible levels of security that could be applied in the integrated security system and SCA.

One of them is already implemented in the application as it is described herein. Clients will have to enter a username and password when entering the SCA as follows:

1. When a user logs in, the SCA creates a SessionID which is a unique value (GUID). The SCA then encodes UserName and SessionID using 128 bit key and puts these three strings (UserName, SessionID and an encoded UserName+SessionID) into a cookie, which is sent to the client with an HTML page.
2. When a client sends/requests any data to/from a SCA page on a web server, the SCA takes these three strings from the cookie, encodes UserName and SessionID using the same key and compares the result with the encoded string from a cookie.

The SCA then determines the access rights for this particular client. These access rights will determine to what particular parts of the SCA, the client has access and if he can edit or just view data.

The mentioned 128 bit key could also be used to encrypt the XML code that is used for communication between the BS and checkpoints. This will have to be looked at on an individual basis and will be further customized depending upon client needs.

On top of the security that is already built into the SCA, it is possible to provide extra security by using so called Secured Socket Layer (SSL) Web Server Certificate.

It should be understood, however, that even though these numerous embodiments, examples, characteristics and advantages of the invention have been set forth in the foregoing description, together with details of the structure and function of the invention, the disclosure is illustrative only, and changes may be made in detail, especially in matters of shape, size, components, configuration and arrangement of parts within the principal of the invention to the full extent indicated by the broad general meaning of the terms in which the appended claims are expressed.

What is claimed is:

1. A security system, comprising:

a guard device configured to be worn or carried by a human security guard and comprising a microprocessor control having wireless communications capabilities;

a checkpoint configured to receive signals transmitted from a plurality sensor devices configured to detect conditions at a site, wherein the checkpoint comprises a checkpoint data processing subsystem configured to remotely monitor the signals from the plurality of sensor devices; and a headquarters processor configured to receive the signals from the checkpoint and to process the signals to determine if an event has occurred.

2. The security system of claim 1, wherein the headquarters processor is configured to process the signals to determine whether to perform an action.

3. The security system of claim 2, wherein the headquarters processor is configured to perform the action of notifying a human guard of the event.

4. The security system of claim 2, wherein the headquarters processor is configured to perform the action of sending instructions to a human guard.

5. The security system of claim 1, further comprising a base station configured to remotely transmit the signals from the site for receipt by the headquarters processor.

6. The security system of claim 1, wherein the guard device is configured to be controlled and monitored through wireless communication protocols.

7. The security system of claim 1, wherein at least one of the sensor devices is configured to be controlled and monitored through hard-wired communication protocols.

8. The security system of claim 1, wherein at least one of the sensor device is associated with at least one of a motion-sensing device, a radio frequency tracking device, a fire or smoke detecting device, an audio system or a video camera system for transmitting or analyzing auditory or visual signals, a climate control system, a heating ventilation and air conditioning system, an elevator device, and an energy sensing device.

9. The security system of claim 1, wherein the guard device is associated with an identification tracking device.

10. The security system of claim 9, wherein the identification tracking device is configured to communicate via a global positioning satellite system.

11. The security system of claim 1, wherein at least one of the sensor devices is coupled to guard device.

12. The security system of claim 1, wherein the headquarters processor is configured to process the signals to determine if the event has occurred for facilitating at least one of supervision by a human guard, situation analysis by a human guard, intervention by a human guard, and decision making regarding security countermeasures by a human guard.

13. The security system of claim 1, wherein the guard device is a hand-held computer.

14. A security system, comprising:

a guard device configured to be worn or carried by a human security guard and comprising a microprocessor control having wireless communications capabilities;

a sensor configured to detect conditions at a site and provide signals indicative of the conditions detected; and a headquarters processor configured to receive the signals from the sensor, wherein the headquarters processor is configured to process the signals to determine an action to be taken if an event has occurred;

wherein the action includes sending instructions to a human guard.

15. The security system of claim 14, further comprising a base station configured to remotely transmit the signals from the site for receipt by the headquarters processor.

16. The security system of claim 15, wherein the base station is configured to translate the signals from the sensor into a universal language.

17. The security system of claim 16, wherein translation of the signals to the universal language includes encryption.

18. A security system, comprising:

a guard device configured to be worn or carried by a human security guard and comprising a microprocessor control having wireless communications capabilities;

a sensor device configured to detect conditions at a site;

a checkpoint at the site configured to receive signals transmitted from the sensor device that are indicative of the conditions detected, the checkpoint comprising a data processing subsystem configured to remotely monitor signals from the sensor device; and a headquarters processor configured to receive signals from the checkpoint and to process the signals to determine if an event has occurred.

19. The security system of claim 18, wherein the headquarters processor is configured to process the signals to determine an action to be taken if the event has occurred.

20. The security system of claim 18, further comprising a base station configured to remotely transmit the signals from the site for receipt by the headquarters processor.

* * * * *